US006035570A

United States Patent [19]

Maglio

[11] Patent Number: 6,035,570

[45] Date of Patent: Mar. 14, 2000

[54] DEVICE FOR TRACKING GARMENTS

[76] Inventor: Francesco Maglio, 567 Brownridge Drive, Thornhill, Ontario, Canada, L4J 6B6

[21] Appl. No.: 09/080,114

[22] Filed: May 18, 1998

[51] Int. Cl.[7] ..... G09F 3/10

[52] U.S. Cl. ..... 40/673; 40/322

[58] Field of Search ..... 40/673, 674, 322, 40/299.01

[56] References Cited

U.S. PATENT DOCUMENTS

| | | | |
|---|---|---|---|
| 1,336,270 | 4/1920 | Zimmerman | 40/674 X |
| 1,541,459 | 6/1925 | Ahrnke | 40/674 X |
| 1,663,185 | 3/1928 | Webb et al. | 40/674 X |
| 2,091,346 | 8/1937 | Wright | 40/674 X |
| 4,780,974 | 11/1988 | Mitchell | 40/673 X |
| 4,791,742 | 12/1988 | Stover | 40/674 X |
| 4,862,617 | 9/1989 | Cooke, Jr. et al. | 40/673 X |

*Primary Examiner*—Joanne Silbermann
*Attorney, Agent, or Firm*—David W. Wong

[57] ABSTRACT

The tracking device is adapted for attaching to clothing and/or clothing accessories for tracking the date, the event and any remarks pertaining to the event in which the clothing and/or clothing accessories were worn. The device is a sheet material having a circular opening and two parallel scored lines extending from one edge to a portion close to the other edge opposite to the first edge. The scored lines are designed to be punctured selectively to form slot openings of selective shape and length for attaching the device to the clothing and/or the clothing accessories.

4 Claims, 2 Drawing Sheets

DEVICE FOR TRACKING GARMENTS

BACKGROUND OF THE INVENTION

This invention relates to a device for identifying and tracking garments and/or accessories previously worn to particular social functions.

Many people, particularly those working in the hospitality industry and sale, appropriate dressing of clothes for various social occasions is very important in order to create a desirable image and social impression to clients, acquaintances and other people met under such occasions. It is particularly important for repeating social functions to which the same people may always attend. Repeated wearing of the same clothes to such social functions would inherently create the impression of thriftiness which may be detrimental to the personal image. Such undesirable happening may be avoided by having a large wardrobe; however, in most cases, the cost of acquiring a large wardrobe is economically infeasible. Even for those having a large wardrobe, there is still the potential that same clothes may be unknowingly worn to the same functions due to the lack of means of tracking what has been worn previously to such various occasions.

In U.S. patent application Ser. No. 08/771,299 by the present Applicant, filed on Dec. 20, 1996, it is shown a method and device for tracking the wearing of clothes to various previous social occasions. The device shown therein, although provides the desired functions, is costly and relatively complex to fabricate.

SUMMARY OF THE INVENTION

It is the principal object of the present invention to provide a garments tracking device which is simple in construction and yet functions effectively.

It is another object of the present invention to provide a garments tracking device which may be used for a large variety of clothing.

It is another object of the present invention is to provide a garments tracking device which is inexpensive to produce.

It is yet another object of the present invention to provide a garments tracking device which is inexpensive and may be disposable.

Briefly, the clothe tracking device comprises a sheet material body having a surface area adapted for recording information of event in which said clothe was worn. An opening is formed in the sheet material and the opening is reinforced around its edge with a reinforced material. A first scored line is formed in the body. The first scored line extends from one edge of the body to an area adjacent to the opening. The first scored line is adapted to be punctured selectively to form a slot opening of a selective shape and length. A second scored line formed in the body and located adjacent to a lower edge therein. The second scored line is substantially parallel to the first scored line and also adapted to be punctured selectively to form a second slot opening of a selective shape and length.

BRIEF DESCRIPTION OF THE DRAWINGS

Other objects of this invention will appear in the following description and appended claims, reference being made to the accompanying drawings forming a part of the specification and in which

DETAILED DESCRIPTION OF THE PREFERRED EMBODIMENTS

Figure 1:
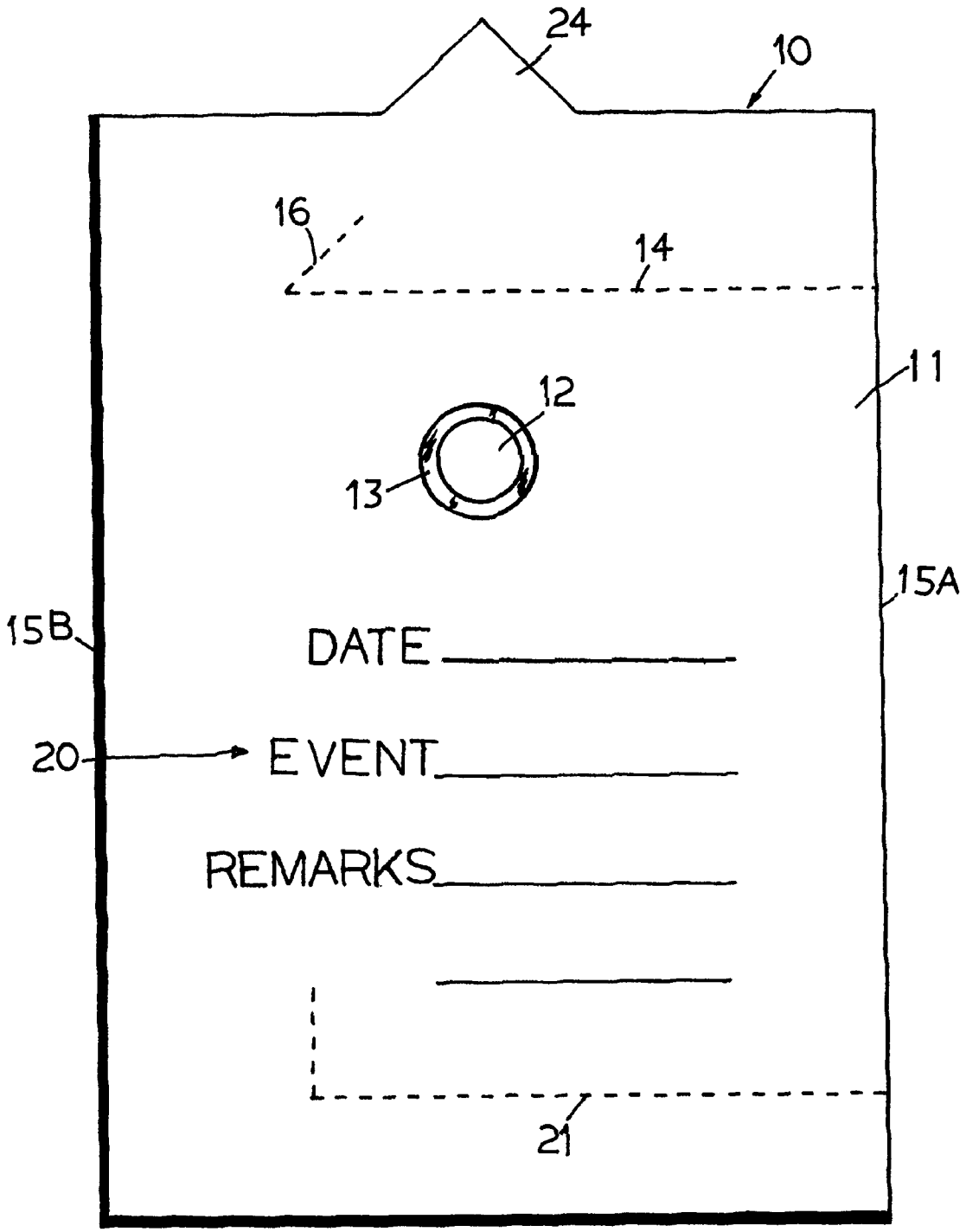
FIG. 1 is a perspective front view of the tracking device according to the present invention.
Figure 2:
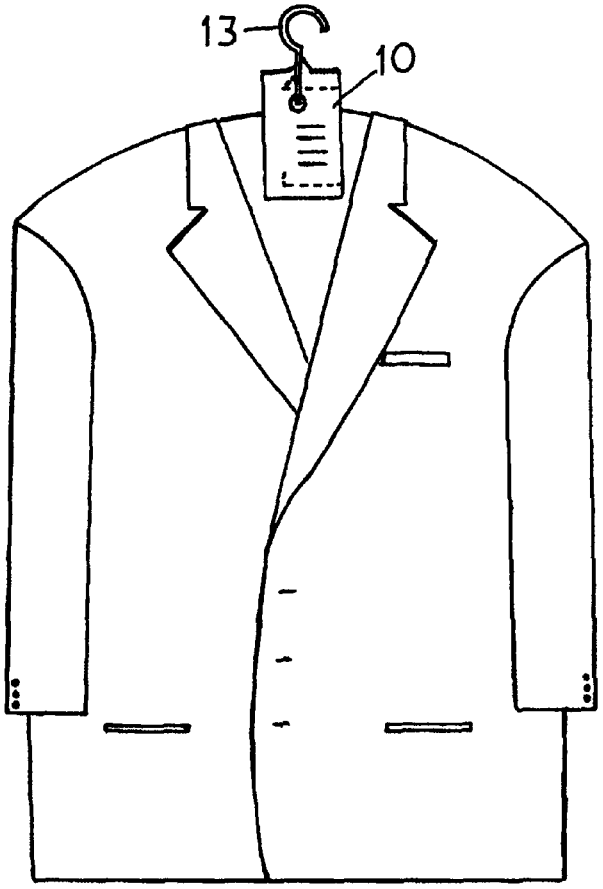
FIG. 2 is a perspective front view of a jacket having the tracking device according to the present invention attached to the clothe hanger.
Figure 3:
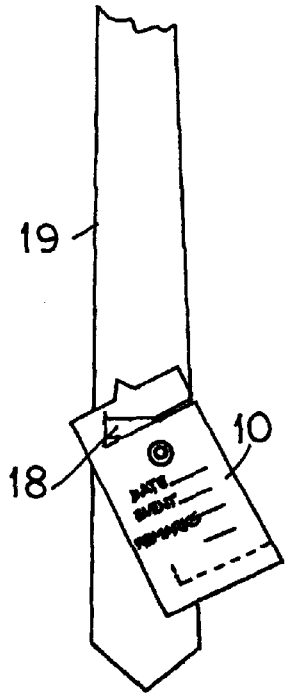
FIG. 3 is a perspective front view of a neck tie having the tracking device attached to the restraining loop normally provided on a neck tie.
Figure 4:
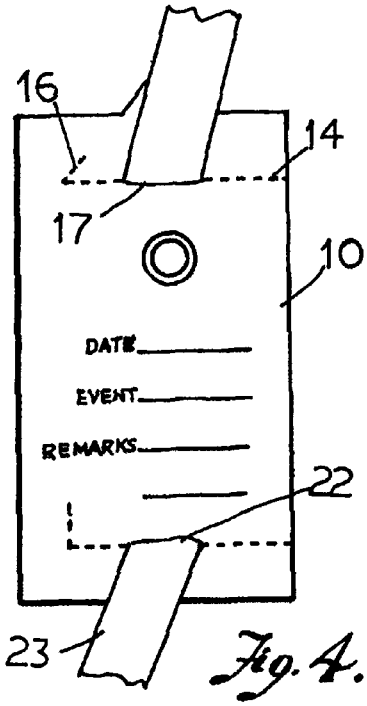
FIG. 4 is a perspective front view of tracking device attached to a belt or similar clothing accessory.

With reference to the drawings wherein like reference numerals designate corresponding parts in the several views, the tracking device 10 according to the present invention has a body 11 which is made of a sheet material such as plastics or stiff paper or a combination of both material. The material preferably can accept writing thereon with erasable ink or pencil. The body 11 may be generally rectangular in shape; however, it will be appreciated by those skilled in the art that it may have other shapes such as square, circular, or other attention drawing shapes or figures and a variety of colors. A rectangular shape is shown for illustration purposes. An opening 12 is formed in the body 11 such that the device 10 may be attached to a clothe hanger 13 as best shown in FIG. 2. The opening 12 is reinforced around its edges with a reinforcing material 13 such that the device 10 can withstand the normal handling of the clothe without accidental tearing. A generally L-shaped or hook-shaped first scored line 14 is formed close to one side of the device 10. The first scored line 14 extends from one side 15A of the device 10 to a bent portion 16 of the L-shape or hook-shape located close to the other side 15B of the body 11. The first scored line 14 may be torn open in whole or in part to form a slot or opening 17 as best shown in FIG. 4 such that the device 10 may be attached to a selected conspicuous part of the clothing or clothing accessory. As shown in FIG. 3, the first scored line 14 is completely punctured to the edge of the device such that it can be attached to the restraining loop 18 normally provided on a neck tie 19. The bent portion 16 allows the device 10 to be tilted in a slanted position if desired. A marking area 20 is provided on the surface of the device 10, on which the information such as Event, Date of the Event, Remarks may be entered thereon. A second L-shaped scored line 21 generally parallel to the first scored line 14 and is formed close the opposite side of the first side adjacent to the first scored line 14. The second scored line 21 may extend to the same side 15A or the opposite side 15B as the first scored line14. A second scored line 21 extending to the same side of the first scored line 14 is shown in the drawings for illustration purposes. The second scored line 21 may also be punctured selectively in whole or in part to form a second slot opening 22 such that the device 10 may be attached to a belt 23 by inserting the latter through the slot openings 17 and 22 with the marking area 20 showing, as best shown in FIG. 4. A tab 24 may be provided on one side of the device 10 to facilitate handling.

A plurality of the device 10 may be produced in a book form such that one sheet may be tom off at a time for use. The device 10 may be attached to the clothe, or a clothing accessory, or a clothe hanger selectively as described above, and the event, date of the event, any remarks may then be entered thereon such that suitable clothing or an ensemble of clothing may be selected for wearing to a particular occasion without encountering the above stated embarrassment.

It will thus be seen that the objects set forth above among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

I claim:

1. A clothing tracking device comprising, a substantially rectangular body made of a sheet material, a circular opening formed in said body and located in proximity to a top edge of said body, and having a reinforced circular edge, a substantially hook-shaped scored line formed adjacent to said upper edge of said body, and located in proximity to and above said circular opening, said hook-shaped scored line extending from one side edge of said body to an inside area of said body adjacent to said top edge and in proximity to a second side edge located opposite to said one side edge, said hook-shaped scored line being adapted to be punctured selectively to form a first slot opening of a variable selected length, a substantially L-shaped scored line formed adjacent to a lower edge of said body, said L-shaped scored line being substantially and mutually parallel to, and spaced from, said hook-shaped scored line and extending also from said one side edge of said body to a second inside area of said body located in proximity to said second side edge and adjacent to said lower edge, said L-shaped scored line being adapted to be punctured selectively to form a second slot opening of a variable selected length, a recording area formed in a surface of said body and located between said circular opening and said L-shaped scored line, said recording area having spaces adapted for recording date, event, and remarks of an occasion wherein said clothing was worn.

2. A clothing tracking device according to claim 1 wherein said sheet material is plastic.

3. A clothing tracking device according to claim 1 wherein said sheet material is paper.

4. A clothing tracking device according to claim 2 including a tab formed in said upper edge of said body.

* * * * *